United States Patent [19]

Wilson

[11] 4,286,514

[45] Sep. 1, 1981

[54] TEA BAG COMPRESSOR

[76] Inventor: Reginald D. Wilson, 2601 Roslyn Ave., Baltimore, Md. 21216

[21] Appl. No.: 181,873

[22] Filed: Aug. 27, 1980

[51] Int. Cl.[3] ..... B30B 5/02

[52] U.S. Cl. ..... 100/211; D7/105; 100/234; 294/99 R

[58] Field of Search ..... 100/132, 211, 234; 426/80; 294/33, 99; 81/43; 128/354; 99/295, 323; D7/105

[56] References Cited

U.S. PATENT DOCUMENTS

| | | | |
|---|---|---|---|
| D. 192,377 | 3/1962 | Nelson | D7/105 |
| D. 251,285 | 3/1979 | Wagner | D7/105 |
| D. 254,466 | 3/1980 | Carson | 100/234 X |
| 197,372 | 11/1877 | Huffman | 294/99 R |
| 1,427,044 | 8/1922 | Wilson | 294/99 R |
| 2,483,985 | 10/1949 | Sonn | 100/234 |
| 2,683,274 | 7/1954 | Kappes | 81/43 X |
| 4,126,962 | 11/1978 | Polcaro | 294/99 R X |

*Primary Examiner*—Billy J. Wilhite
*Attorney, Agent, or Firm*—D. Paul Weaver

[57] ABSTRACT

A one-piece spring material finger-operated tongs for compressing tea bags is sized for convenient holding in one hand with broad upwardly convergent tea bag compressing jaw plates projecting forwardly of a pair of finger grip tabs near the center of the device. When the compressor is closed on the tea bag, the bag is progressively squeezed from top-to-bottom across its full width to drain downwardly into a tea cup. The greatest compression on the tea bag is at its bottom.

4 Claims, 6 Drawing Figures

FIG.1
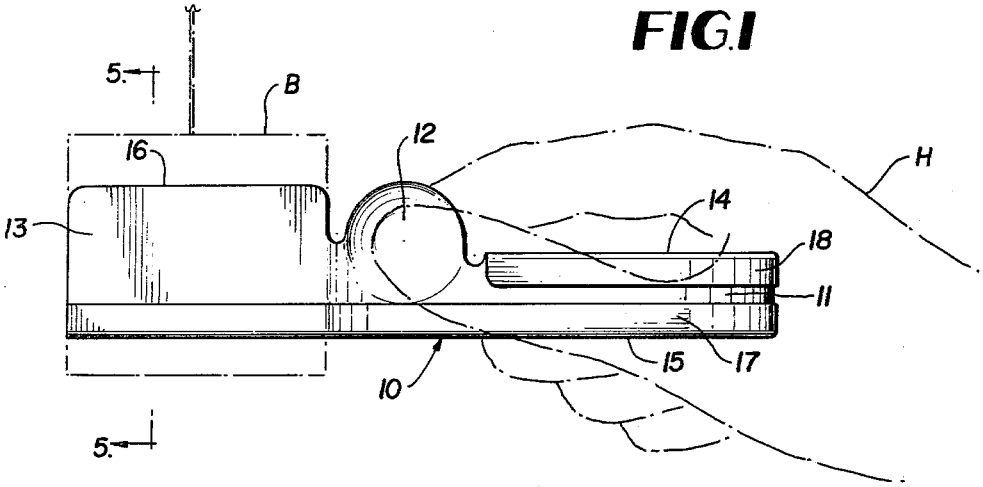
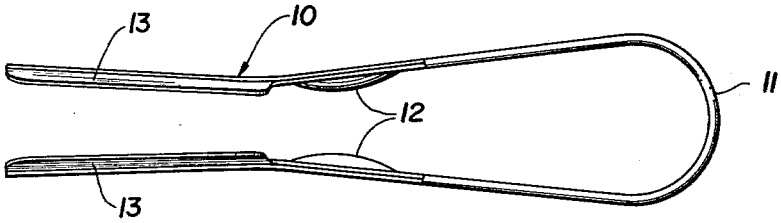
FIG.2
FIG.3
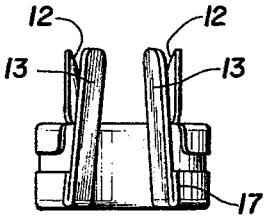
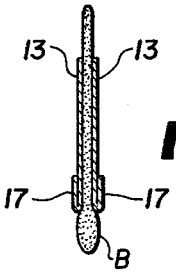
FIG.5
FIG.4
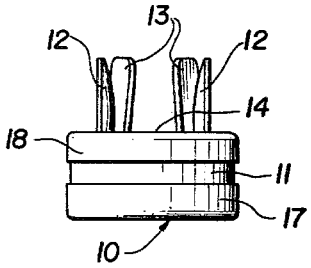
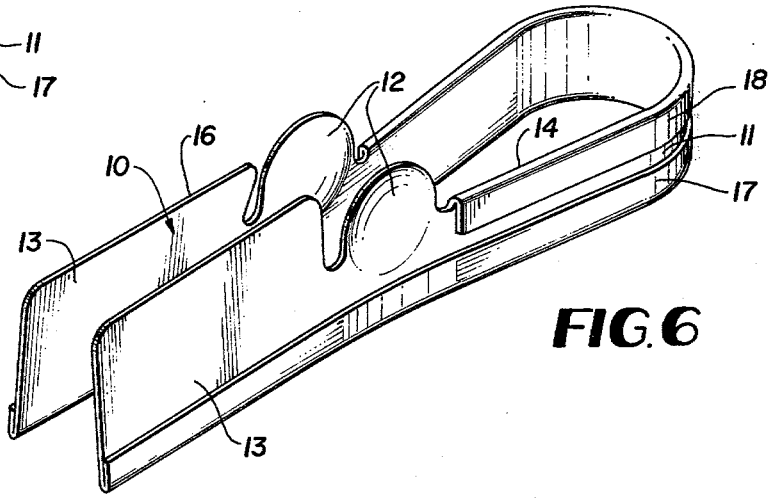
FIG.6

TEA BAG COMPRESSOR

BACKGROUND OF THE INVENTION

The object of this invention is to satisfy a need for a low cost, convenient and efficient tea bag compressor or squeezer, which need has not been satisfied by any known prior art device.

A great many prior art devices in the nature of tongs, pliers and other gripping and manipulating tools are known. However, none of these devices can be used conveniently and efficiently to compress a tea bag in order to drain the liquid therefrom downwardly into a tea cup. As a result, most users of tea bags resort to haphazard squeezing methods, such as wrapping the attached string around a bag and spoon, or compressing the bag between the fingers. Many users simply place the tea bag aside without squeezing it and in so doing the most concentrated tea essence is lost. All of these haphazard procedures tend to be messy, as is well known.

The above problems are overcome entirely by the present invention. A small one-piece spring compressor or tongs is provided, to be held in one hand and operated by the thumb and index finger. Balanced finger grip elements are provided near the center of the device and the rearward spring loop fits conveniently into the palm of the hand. Two broad flat jaw plates extend forwardly from the finger grip elements and converge slightly upwardly. As the jaw plates close upon a tea bag, they not only compress it across its full width, but also apply compression downwardly in a progressive manner from top-to-bottom as the convergent jaw plates move into parallelism due to increasing finger pressure. This causes the liquid in the tea bag to drain downwardly into the cup in a very efficient manner to avoid the usual dripping and soiling of the saucer and surroundings. The device can be manufactured advantageously from stainless steel or from a durable plastics. Advertising indicia from a tea bag manufacturer or restaurant can be placed on the outer faces of the jaw plates. Thus, the device may be used as an inexpensive promotional and advertising item due to its economy of manufacture.

BRIEF DESCRIPTION OF THE DRAWINGS

FIG. 1 is a side elevation of a a tea bag compressor according to the invention depicting the use thereof.

FIG. 2 is a top plan view of the device.

FIG. 3 is a frontal end elevational view thereof.

FIG. 4 is a rear end elevational view of the device.

FIG. 5 is a cross sectional view taken on line 5—5 of FIG. 1.

FIG. 6 is a perspective view of the device.

DETAILED DESCRIPTION

Referring to the drawings in detail wherein like numerals designate like parts, a one-piece tea bag compressor or squeezer 10 preferably formed of stainless steel or other suitable spring material includes a rear spring loop 11 sized to fit conveniently in the palm of one hand H of a user. Immediately forwardly of the spring loop 11, a pair of laterally opposed upstanding preferably concave finger grip tabs 12 are provided on the device near its longitudinal center for convenient engagement by the thumb and index finger.

Forwardly of the grip elements 12, a pair of broad flat squeezing jaw plates 13 are provided and these jaw plates extend to the leading end of the device, as illustrated. As best shown in FIG. 3, the two jaw plates 13 converge somewhat upwardly and the two convergent planes of the jaw plates extend from the top to the bottom of the device. This upwardly convergent relationship of the jaw plates 13 is an important feature which causes the liquid in a tea bag B, FIG. 1, to drain downwardly into a tea cup as the jaw plates are progressively closed and move into parallelism with the bag B between them.

As shown in the drawings, the upper edge 14 of spring loop 11 is of lesser height measured from the bottom edge 15 of the device than the jaw plates 13 and finger grip tabs 12. This promotes holding comfort and convenience of use. As shown in FIG. 2, the jaw plates 13 are roughly parallel and may diverge slightly longitudinally forwardly when the implement is in a relaxed state. In such state, the jaw plates 13 are biased apart at their top edges 16 a distance of roughly three-quarters of an inch. While dimensions are not critical, in a preferred embodiment, the overall length of the tea bag compressor is roughly four and one-half inches and the jaw plates 13 measure roughly one and three-quarter inches long by one inch in height between the edges 15 and 16. These dimensions can be varied.

In order to strengthen the device, continuous flange beads 17 and 18 are formed along the bottom and top edges of spring loop 11 with the bottom flange bead 17 extending to the forward tips of jaw plates 13.

In use, the wet tea bag is positioned as shown in FIG. 1 with the charge of tea in the lower portion of the bag squarely between the two jaw plates 13. When finger pressure is applied to the tabs 12, the jaw plates close compressively in the manner already described and the bag is neatly squeezed progressively downwardly to drain the liquid completely from the bag into the underlying vessel, not shown. Upon remvol of finger pressure the device springs open.

The greatest compression of the tea bag occurs at the bottom of the same when the jaw plates 13 are parallel. This is facilitated by the fact that the bottom bead 17 renders the jaw plates stiffer at their bottoms.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A tea bag compressor comprising a one-piece spring member having a rear spring loop sized for convenient holding in one hand, a pair of laterally opposing finger grip tabs on said spring member at the forward end of the spring loop and near the longitudinal center of said member, and a pair of laterally opposing flat plate-like compression jaws on said member forwardly of the finger grip tabs and extending to the forward end of said member and being convergent upwardly in two planes extending from the bottom edge of the spring loop to an elevation substantially above the upper edge of the spring loop.

2. A tea bag compressor as defined in claim 1, and stiffening beads formed continuously along the top and bottom edges of the spring loop, the bottom edge bead extending continuously to the forward ends of the two sides of the spring member, said sides being biased into spaced relationship when the spring loop is relaxed.

3. A tea bag compressor as defined in claim 2, and the one-piece spring member being formed of metal.

4. A tea bag compressor as defined in claim 1, and said compression jaws being roughly rectangular and elongated in the front-to-back direction and having a front-to-back width capable of spanning the full width of a conventional tea bag whereby pressure can be applied to the bag across its full width and progressively downwardly as the convergent jaws are closed into parallelism with the greatest compression being exerted on the tea bag near its bottom.

* * * * *